United States Patent [19]

Tanigami

[11] 4,339,209

[45] Jul. 13, 1982

[54] MANUALLY OPERATED TYPING DEVICE

[75] Inventor: Satoshi Tanigami, Ichikawa, Japan

[73] Assignee: Kabushiki Kaisha Uchida Yoko, Japan

[21] Appl. No.: 134,960

[22] Filed: Mar. 28, 1980

[30] Foreign Application Priority Data

Aug. 31, 1978 [JP] Japan ..... 53-106908

[51] Int. Cl.[3] ..... B41J 1/28

[52] U.S. Cl. ..... 400/142; 400/134.5; 400/88

[58] Field of Search ..... 400/134.4, 134.5, 88, 400/470, 134.2, 132, 142, 174; 101/28, 29, 31, 93.18, 93.19

[56] References Cited

U.S. PATENT DOCUMENTS

| | | | |
|---|---|---|---|
| 1,407,492 | 2/1922 | Steere | 400/134.2 |
| 2,873,013 | 2/1959 | Thiene et al. | 400/470 X |
| 3,155,215 | 11/1964 | Avery | 400/134.5 |
| 3,307,674 | 3/1967 | Massen et al. | 400/134.5 |
| 3,372,787 | 3/1968 | Humphrey et al. | 400/134.5 |
| 3,756,153 | 9/1973 | Cohen | 101/368 |
| 4,084,679 | 4/1978 | Fujita | 101/134.5 X |

FOREIGN PATENT DOCUMENTS

| | | | |
|---|---|---|---|
| 603909 | 4/1926 | France | 400/132 |

*Primary Examiner*—William Pieprz

*Assistant Examiner*—C. Pearson

*Attorney, Agent, or Firm*—McGlew and Tuttle

[57] ABSTRACT

A manually operated typing device comprises a pistol-shaped housing which is formed with a hollow space at the rear part for receiving the tape magazine, is formed with another hollow space at the middle part for receiving a typing handle, is formed with an extension from one of the both side walls for supporting a rotary disc and further is formed with a tape guiding groove on the longitudinally extending upper portion, a rotary disc rotatably supported on said extension from the side walls, said rotary disc being formed with a series of substantially square holes along the periphery, a plurality of typing head assemblies displaceably disposed in the respective substantially square holes of said rotary disc, a hammer member adapted to depress the selected typing head assembly, a typing handle arranged rotatable about a pivotal pin which is extended between the both side walls of the housing, said typing handle being pivotally connected to said hammer member at the front end thereof, a ratchet wheel operatively connected to the typing handle via a pivotal lever, which is intermittently rotated by an angle corresponding to one pitch of typing head, when the typing handle is released from the gripped state, and a pair of rollers adapted to intermittently unreel the tape by one pitch of typing head by means of said ratchet wheel.

8 Claims, 5 Drawing Figures

MANUALLY OPERATED TYPING DEVICE

BACKGROUND OF THE INVENTION

The present invention relates to a manually operated typing device for typing letters, numerals or the like one by one on a tape unreeled from a tape magazine and, more particularly, the invention relates to a typing device for typing on a predetermined length of tape a certain display such as person's name, company name, name of goods or the like, which is composed of a combination of required letters; or a numeral display such as a telephone number, selling price or the like composed of a combination of required numerals; or both.

Usually as a typical display means for person's name, company name, name of goods, selling price or the like, a label is employed and the content of display is normally printed on it. The conventional display means, such as labels, is manufactured at a lower cost, when a large number of display means is required. In case that, however, a single piece or at most several pieces of display means is required. The conventional printed label is very uneconomical due to expensive printing cost. In some cases, a few pieces of display means are prepared by hand writing, but letters and/or numerals are often written in a different size and fashion, resulting in unpleasant appearance.

SUMMARY OF THE INVENTION

Thus the present invention is intended to develop a manually operated device by which a small number of display means is effectively manufactured at an inexpensive cost. A tape, unreeled from a tape magazine, is employed in the typing device of the invention as material for the display means. The manually operated typing device, in accordance with the present invention, is of the type which includes the operational steps of unreeling the tape by a predetermined length from the tape magazine, actuating a typing handle which initiates the typing operation by thereby depressing a selected typing head having a typing face, which is formed with a required letter, numeral, symbol or the like, then releasing the gripped typing handle, then unreeling another predetermined length of tape for a second typing operation with the use of another typing head having a different letter, numeral, symbol or the like or its typing face, and repeating the aforesaid operational steps at predetermined times, whereby a piece of typed display tape comprising the predetermined combination of letters, numerals, symbols or the like is obtained. To ensure the above described typing operations, the manually operated typing device of the invention includes a pistol-shaped housing which is formed with a hollow space at the rear part for receiving the tape magazine, and another hollow space at the middle part for receiving the typing handle, an extension from one of the both side walls is provided for supporting a rotary disc and, further, is formed with a tape guiding groove on the longitudinally extending upper portion. A rotary disc is rotatably supported on said extension from the side wall of the housing. The rotary disc is formed with a series of substantially square holes along the periphery for receiving a type head assembly. A plurality of type head assemblies, is inserted in the respective substantially square holes composed of a said rotary disc. Each assembly includes a typing head with an ink source contained therein a typing face having a letter, numeral, symbol or the like is protruded or recessed in the typing head, a hammer member adapted to depress the selected typing head assembly, arranged vertically displaceable along the side wall in the housing, a typing handle disposed in the middle hollow space of the housing, arranged rotatable about a pivotal pin located around at the middle of the handle, which is extended therethrough between the both side walls, a ratchet wheel operatively connected to said typing handle via a pivotal lever, which is adapted to be intermittently rotated by an angle corresponding to one pitch of typing head by means of the ratch formed at the extreme end of the pivotal lever, when the typing handle is released from the gripped state, and a pair of rollers adapted to unreel the tape from the tape magazine by one pitch of typing head with the aid of said ratchet wheel. To allow the typing head to resume its upper original position and the typing handle to be rotated to the original position after completion of typing operation, a coil spring is arranged between the typing head and the upper portion of the hammer member, wherein the typing handle is pivotally connected to the lower end of the hammer member by means of a pivotal pin at the front end of said typing handle.

In a preferred embodiment of the invention a cutting mechanism is provided at the front part of the housing for the purpose of cutting the tape. The tape may be cut by operating a cutting handle after completion of typing the required display such as certain person's name, company name, name of goods or the like which is composed of a combination of the required letters and/or telephone number, selling price or the like which is composed of a combination of the required numerals. The said cutting mechanism comprises a cutter means fixedly arranged on the upper portion of the front part of the housing in such a manner that it is bridged over the tape guiding groove and a cutting handle arranged rotatable about a pivotal pin located in the vicinity of the front end of the housing, which is extended therethrough between the both side walls, said cutting handle being provided with a cutter anvil secured thereto in a position corresponding to said cutter means, whereby cutting operation is performed between the cutter means and cutter anvil by actuating the cutter handle by an operator's hand.

To allow the cutting handle to resume its original position after completion of cutting operation a coil spring is preferably located around at the middle of the cutting handle.

Thus, it is an object of the present invention to provide a new and unique manually operated typing device for typing on a tape a certain letter display such as person's name, company name, name of goods or the like, or a numeral display such as a telephone number, selling price or the like, or both by repeated operations of selecting a typing head and gripping the typing handle.

It is another object of the present invention to provide a manually operated typing device which is constructed such that the typed tape can be cut to the predetermined length by actuating the cutting handle after completion of typing operations.

It is still another object of the present invention to provide a manually operated typing device which can be smoothly and easily handled without any particular skill required.

It is even still another object of the present invention to provide a manually operated typing device which is simple in structure and is easy to be manufactured.

Other objects and advantageous features of the invention will be readily apparent from the following description with reference to the accompanying drawings.

BRIEF DESCRIPTION OF THE ACCOMPANYING DRAWINGS

Now the present invention will be described in more detail with reference to the accompanying drawings which illustrate a preferred embodiment of the present invention, in which.

DETAILED DESCRIPTION OF THE PREFERRED EMBODIMENT OF THE INVENTION

Figure 1:
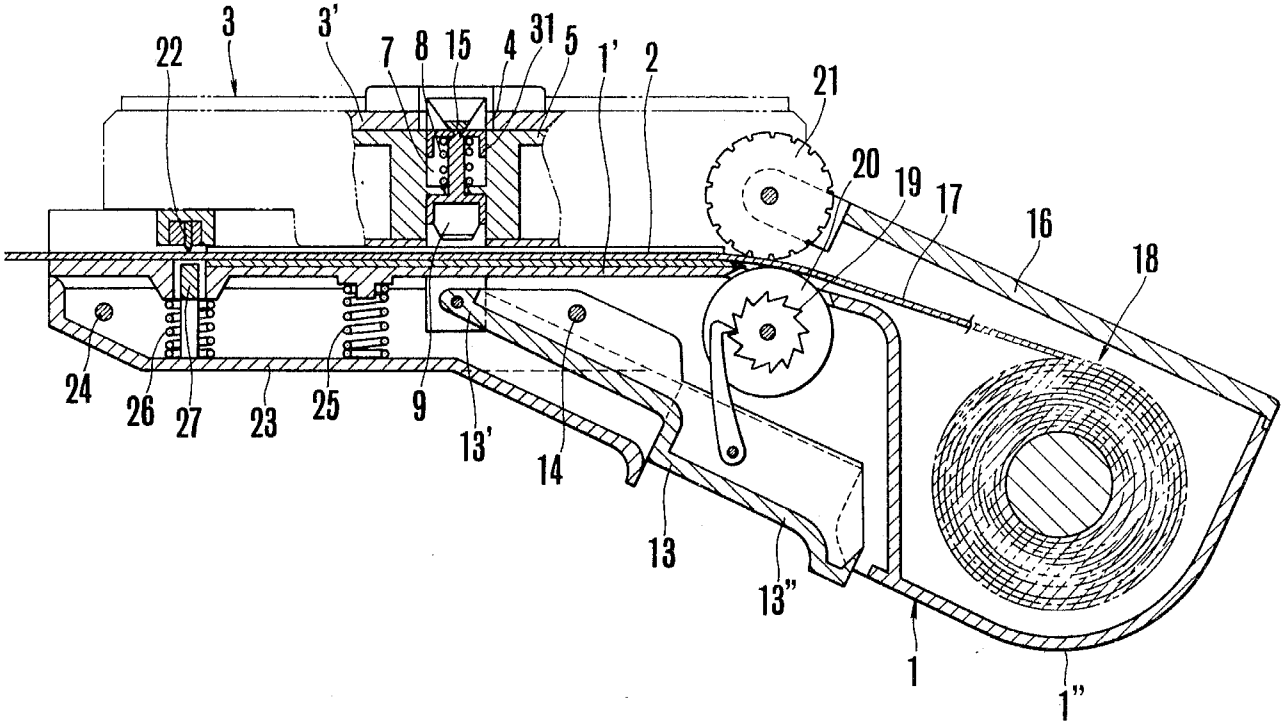
FIG. 1 is a vertical sectional view of a manually operated typing device in accordance with a preferred embodiment of the present invention, sectioned in the longitudinal direction, wherein a rotary disc carrying a series of typing head is partially sectioned.
Figure 3:
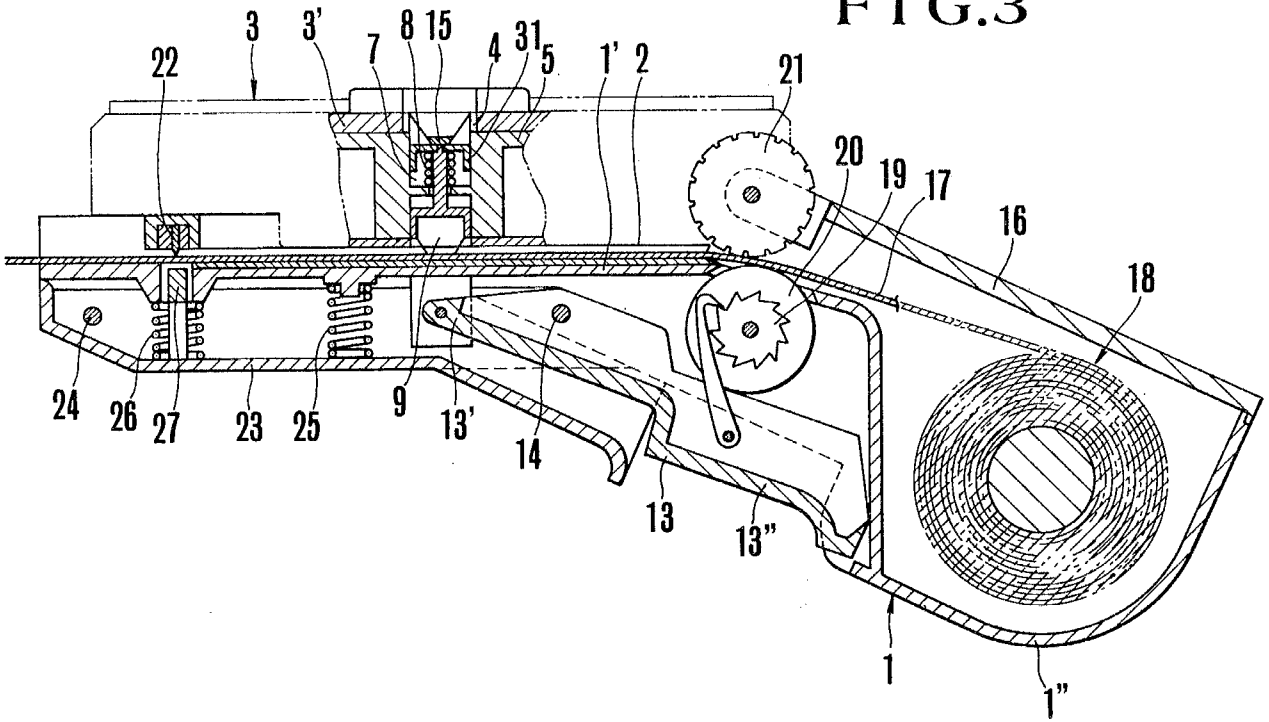
FIG. 3 is a vertical sectional view of the manually operated typing device similar to FIG. 1, illustrating the position of the typing handle when it is gripped up by an operator's hand.
Figure 4:
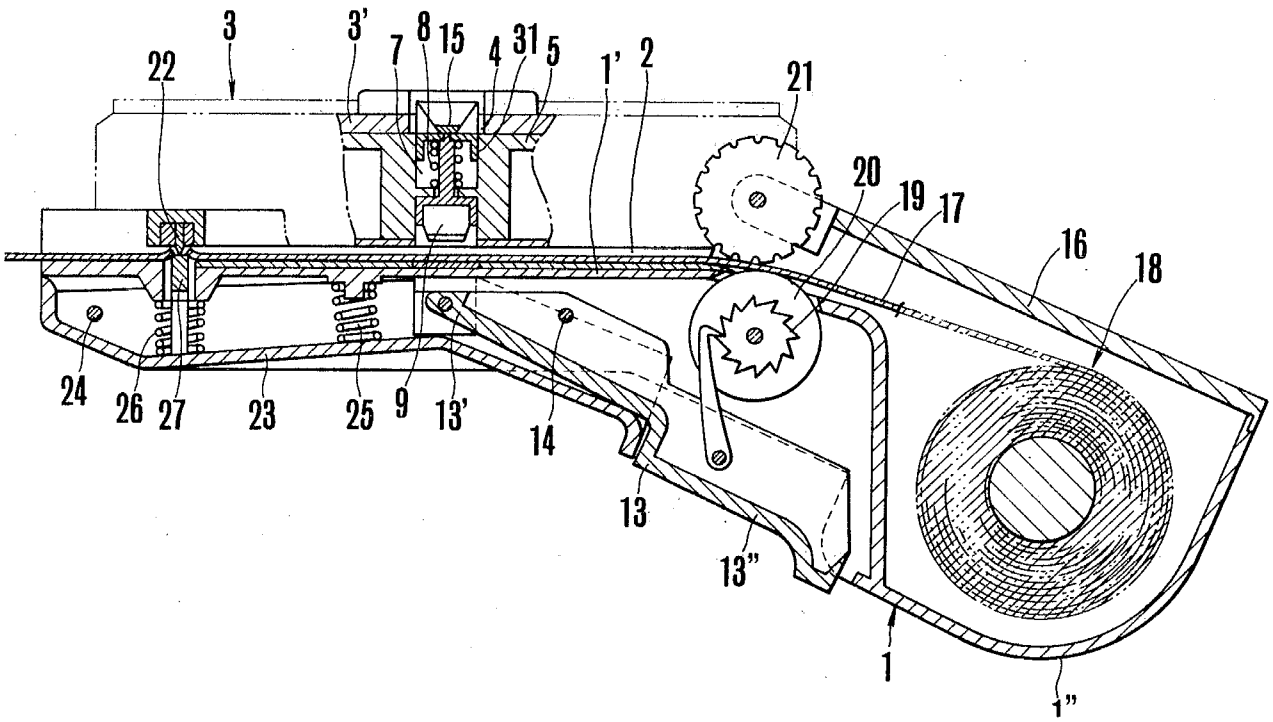
FIG. 4 is another vertical sectional view of the manually operated typing device similar to FIG. 1, in which the typing handle is shown in a position released from gripping operation by the operator's hand.

As shown in FIGS. 1, 3 and 4, a housing 1 of the manually operated typing device of the invention, designed in a form of pistol, is formed with an U-shaped guiding groove 2 on the lateral wall 1', through which a tape to be typed travels. A typing head holding section 3 located adjacent to one of the side walls of the device is secured to an extension of the lateral wall 1' with the aid of a tightening bolt.

Figure 5:
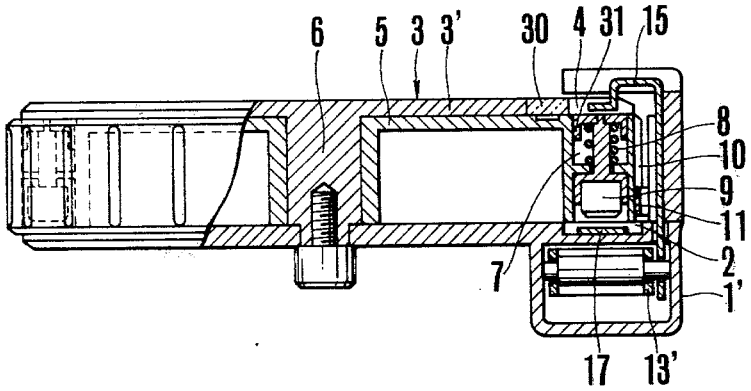
FIG. 5 is a sectional view of the manually operated typing device, taken in line V—V in FIG. 2.

The typing head holding section 3 has a cover plate 3' which is formed with a rectangular opening 4 exactly located above said tape guiding groove 2. The typing head holding section 3 contains a rotary disc 5 which is arranged rotatable about a shaft 6 fastened to the extension of the lateral wall 1', as illustrated in FIG. 5. Said rotary disc 5 is formed with a series of substantially square holes 7 along the periphery thereof, in which a typing head assembly is vertically displaceably inserted to ensure constant typing pressure on the tape. The respective typing head assembly is constructed of a typing head 9 which contains typing ink source, a typing head holder, a coil spring 8 and a retainer 31 which serves as a stopper, as described later. The typing head 9 is adapted to be depressed by means of a hammer member 15 to perform typing operation. As the typing head 9 is released from depression by means of the coil spring 8, it resumes the original inoperative position.

Figure 2:
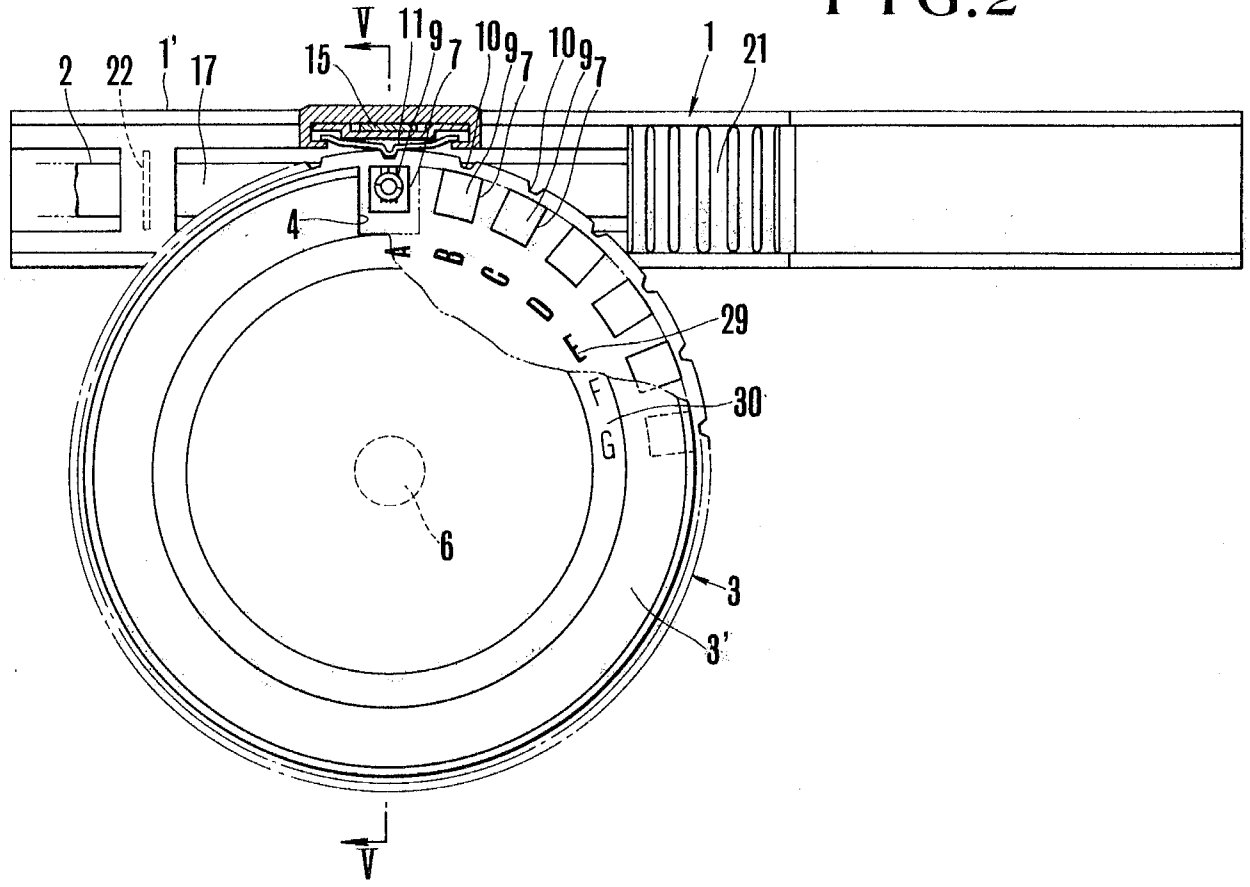
FIG. 2 is a plan view of the manually operated typing device as illustrated in FIG. 1, wherein the typing head actuating mechanism and a part of the rotary disc are sectioned in the horizontal direction.

As apparent from FIG. 2, the rotary disc 5 has a series of recesses 10 on its outer periphery in the vicinity of the square hole 7, into which a protruded portion of a leaf spring 11 is adapted to come in engagement, whereby temporary stopping is ensured for the rotary disc 5, when the required typing head 9 is located just below the rectangular opening 4 by rotating said rotary disc 5. It is to be noted that said leaf spring 11 is securely disposed in an extension of the side wall of the housing 1.

In the middle portion of the housing 1 is provided a typing handle 13 which is arranged rotatable about a pivotal pin 14 which is horizontally extended through said typing handle 13 at its middle part and secured to the both side walls of the housing. The typing handle 13 is pivotally connected to the hammer member 15 at its front end 13', whereby the latter is displaced downwards to depress the typing head 9, as the operator grips the handle 13 by his hand at the rear part 13''.

In the rear portion 1'' of the housing 1 is located a tape magazine 18 which is adapted to be mounted in the hollow space of the housing, when a detachable cover 16 is removed. Thus the tape 17 to be typed is unreeled from the tape magazine 18. Further to ensure stepwise displacement of the tape 17 by one pitch of typing head along the tape guiding groove 2 by way of gripping operation of the typing handle 13, a roller 20, having a ratchet wheel 19 disposed integral therewith, is rotatably arranged between the both side walls at the bent portion of the housing 1 located substantially in the middle thereof. Additionally just above said roller 20 is arranged a depressing roller 21 which serves for pressing the travelling tape 17 against the lower roller 20, said depressing roller 21 being rotatably held at the front end of the cover 16. Thus the tape can be continuously unreeled by manually rotating said depressing roller 21. It is to be noted that this continuous unreeling of the tape 17 is effected irrespective of intermittent displacement of the tape 17 caused by means of the aforesaid lower roller 20 with the ratchet wheel 19 set fast therewith. As shown, roller 21 is provided with slip preventing means such as serrations, recesses, or the like on the outer surface thereof.

On the upper side of the front portion of the tape guiding groove 2 is fixedly disposed a knife 22 which is bridged thereabove between the both side walls of the housing 1, while a cutting handle 23 is received in the hollow space of the housing 1 at the front portion. Said cutting handle 23 is arranged rotatable about a pivotal pin 24 which is extended therethrough at the front end portion and secured to the both side walls of the housing 1, and further is provided with a coil spring 25 at the middle part, said coil spring 25 serving for resuming the original position of the handle 23 after completion of cutting operation. Furthermore the cutting handle 23 is provided with a cutter anvil 27 in the vicinity of the front end, which is adapted to abut against the upper cutter 22, when the operator gripps it.

In the drawings the reference numeral 29 denotes a display letter which is identical to the letter of the printing head 9, said display letter being prepared on the rotary disc 5 by way of printing, etching or the like, the reference numeral 30 denotes an annular transparent portion of the cover 3', through which the operator can recognize the display letters. The retainer 31 which serves as a stopper is provided for the purpose of limiting vertical displacement of the typing head 9, that is, stroke of the hammer member 15.

Now operation of the manually operated printing device in accordance with the present will be described below.

First, the operator rotates the rotary disc 5 so as to locate the required typing head 9 just below the rectangular opening 4 of the cover 3'. The operator then grips the typing handle 13, whereby the hammer member 15 is depressed, causing the typing face of the typing head 9 to come in pressure contact with the tape 17 in the guiding groove 2. After completion of typing operation he releases the handle 13. Thus, the ratchet wheel 19, lower roller 20 and upper roller 21 are rotated by way of the linkage between the typing handle 13 and ratchet wheel 23 so that the tape 17 to be typed is unreeled from the tape magazine 18 by one pitch of typing head. By repeating the above described operational steps he can obtain the required letter display of person's name, company name, name of goods or the like.

Next, the operator grips the cutting handle 23, causing the cutter anvil 27 to abut against the upper cutter 22, so that the typed tape 17 is cut to the predetermined length. Then he releases the cutting handle 23. Now he has obtained the required display tape on which certain person's name, company name, name of goods or the like is typed.

As apparent from the above description, the manually operated typing device is constructed such that a housing of the device is formed with a tape guiding groove extending in the longitudinal direction on the upper portion and is provided with a rotary disc by one of the both side walls of the housing, said rotary disc being formed with a series of substantially square holes along the outer periphery, in which a typing head is received and being rotatably supported so as to locate the typing head just above the tape guiding groove; a typing handle is arranged in the hollow space of the housing at the middle portion in such a manner that the typing head is depressed against a tape in the guiding groove to an operative position by means of a hammer member linked with said typing handle, when an operator grips it, while said typing head is raised from the tape to an inoperative position, when he releases said typing handle, said hammer member being pivotally connected to the typing handle at the front end; a tape unreeling mechanism is provided in the rear hollow space of the housing, which is constructed so as to unreel the tape from a tape magazine by a predetermined length in cooperation with the typing handle linked therewith, when he releases it; and a cutting mechanism is provided in the front portion of the housing, which is constructed so as to cut the tape with the aid of a cutter and cutter anvil which is adapted to abut against said cutter, when he grips a cutting handle onto which said cutter anvil is securely disposed. Thus by using the manually operated typing device as described above and illustrated in the accompanying drawings the required length of display tape on which a certain combination of letters, numerals or the like is typed can be successively obtained in a simple operational manner.

Thus the present invention has been described with a preferred embodiment with reference to the accompanying drawings, but it should be of course understood that the present invention shouldn't be limited only to the above-described embodiment but it may be changed or modified in a suitable manner without any departure from the spirit and scope of the invention.

What is claimed is:

1. An improved manually operated typing device for typing on a length of tape a display combination of selected letters, numerals or symbols, of the type having elongated housing means having a rear hollow space for housing a tape magazine, a plurality of typing heads, and typing handle means for actuating a selected one of the typing heads, wherein the intended typing operation is performed by way of the operational steps of unreeling, by one pitch of typing head, the tape from the tape magazine disposed in the rear hollow space of the housing means, depressing a selected typing head by actuating the typing handle means so as to type a certain letter, numeral, symbol or the like and repeating the aforesaid operational steps, said device comprising:

a pistol-shaped housing having a hollow space at the rear part thereof for receiving the tape magazine therein, another hollow space in the middle part thereof for receiving the typing handle means therein, an extension extended from one side of said housing, a tape guiding groove on a longitudinally extending upper portion thereof through which the tape is displaced;

a rotary disc rotatably supported on said extension, said rotary disc having a series of substantially square holes along the periphery thereof;

a plurality of typing head assemblies inserted in the respective substantially square holes of said rotary disc, and movable from an upper original position to a lower typing position, each of said typing head assemblies comprising a typing head with an ink source contained therein, and a typing face of a letter, numeral, symbol or the like formed on a bottom end of said typing head;

a hammer member, operable to depress a selected typing head assembly, said hammer member being vertically displaceable along the side of said housing;

the typing handle means comprising a typing handle disposed in said middle hollow space of said housing, a pivotal pin extending through said middle hollow space secured to said housing, said typing handle being secured to said hammer member at the front end of said typing handle, said typing handle being arranged rotatably about said pivotal pin to cause vertical displacement of said hammer member, and a pivotal lever mounted to the rear part of said handle, said pivotal lever including a ratchet member, each typing head assembly including spring means biasing said typing head upwardly to said original position and into contact with said hammer member for returning said typing head after completion of the typing operation, and said typing handle being pivotable about said pivotal pin in a first direction to cause said hammer member to move said type head to said lower position against the bias of said spring means, said spring means upon release of said typing handle moving said typing handle in a second direction opposite to said first direction responsive to movement of said typing head into its upper original position by said spring means.

2. A manually operated typing device as set forth in claim 1, wherein said rotary disc has a series of vertically extending recesses in its outer periphery in the vicinity of said substantially square holes, a leaf spring is mounted along the side of said housing, said leaf spring having a protrusion adapted to be engaged to one of said recesses, whereby a temporary holding of the rotary disc which is rotated to the predetermined position is ensured.

3. A manually operated typing device as set forth in claim 2, further comprising a cover on the upper portion of the rear part of said housing, said cover being operative to allow the tape magazine to be inserted in the hollow space of said housing on removal of the cover, said cover being provided with a roller mounted to the front end thereof.

4. A manually operated typing device as set forth in claim 3, wherein one of said typing head assemblies is arranged displaceable in the vertical direction in a respective one of said substantially square holes of the rotary disc, and stopper means at the upper portion of each of said square holes which serves to limit the displacement of the typing head.

5. A manually operated typing device as set forth in claim 4, wherein said roller is formed with slip prevention means such as serrations, recesses or the like on the outer periphery thereof to ensure unreeling of the tape from the tape magazine without any slippage when the typing handle resumes its original position.

6. A manually operated typing device as set forth in claim 1 or 2 or 3 further comprising knife means fixed on the upper portion of the front part of said housing overlying the tape guiding groove, and a cutting handle disposed in a front hollow space of said housing, a pivotal member extending through said front hollow space secured to said housing, said cutting handle being rotatably mounted on said pivotal member, said cutting handle being provided with a cutter anvil secured thereto in a position corresponding to said knife means.

7. A manually operated typing device as set forth in claim 6, further comprising a spring means mounted at the middle of said cutting handle for biasing it to resume the original position.

8. A manually operated typing device as set forth in claim 7, wherein said cutting handle is located such that the rear part thereof overlaps the front part of said typing handle.

* * * * *

UNITED STATES PATENT AND TRADEMARK OFFICE

CERTIFICATE OF CORRECTION

PATENT NO. : 4,339,209

DATED : July 13, 1982

INVENTOR(S) : Satoshi Tanigami

It is certified that error appears in the above-identified patent and that said Letters Patent is hereby corrected as shown below:

On The Title Page, item (73) should read

-- Kabushiki Kaisha Uchida Yoko and Kokusan Co., Ltd.

Tokyo and Chiba-Ken, Japan --.

Signed and Sealed this

*Seventh* Day of *December 1982*

[SEAL]

*Attest:*

GERALD J. MOSSINGHOFF

*Attesting Officer*

*Commissioner of Patents and Trademarks*